US005839680A

United States Patent [19]

Biagiotti

[11] Patent Number: 5,839,680

[45] Date of Patent: Nov. 24, 1998

[54] MACHINE AND METHOD FOR THE FORMATION OF CORELESS LOGS OF WEB MATERIAL

[75] Inventor: Guglielmo Biagiotti, Lucca, Italy

[73] Assignee: Fabio Perini, S.p.A., Lucca, Italy

[21] Appl. No.: 923,615

[22] Filed: Sep. 4, 1997

Related U.S. Application Data

[62] Division of Ser. No. 523,280, Sep. 5, 1994, Pat. No. 5,690,296, which is a division of Ser. No. 90,519, Jul. 13, 1995, Pat. No. 5,639,046.

[30] Foreign Application Priority Data

Jul. 21, 1992 [IT] Italy ..... FI92A0149
Feb. 15, 1993 [IT] Italy ..... FI93A0022

[51] Int. Cl.[6] ..... B65H 18/28

[52] U.S. Cl. ..... 242/160.1; 242/541.2

[58] Field of Search ..... 242/160.1, 160.2, 242/410, 412, 413.3–413.7, 413.8, 541.2, 541.4, 541.5, 541.6, 541.7, 545.1, 547

[56] References Cited

U.S. PATENT DOCUMENTS

| | | |
|---|---|---|
| Re. 28,353 | 3/1975 | Nystrand et al. . |
| 1,681,046 | 8/1928 | Marresford . |
| 2,706,094 | 4/1955 | Dyken . |
| 2,769,600 | 7/1956 | Kwitek et al. . |
| 2,775,410 | 12/1956 | Schwartz et al. . |
| 2,870,840 | 5/1959 | Kwitek et al. . |
| 3,045,939 | 7/1962 | Vander Waal . |
| 3,065,505 | 11/1962 | Pratt et al. . |
| 3,066,882 | 12/1962 | Havens et al. . |
| 3,116,890 | 1/1964 | Nystrand . |
| 3,179,348 | 4/1965 | Nystrand et al. . |
| 3,250,484 | 5/1966 | Fair . |
| 3,266,744 | 8/1966 | Volm et al. . |
| 3,697,010 | 10/1972 | Nystrand . |
| 3,814,342 | 6/1974 | Fujiwara . |
| 3,850,381 | 11/1974 | Moore . |
| 4,102,512 | 7/1978 | Lewallyn . |
| 4,245,796 | 1/1981 | Eglinton . |
| 4,344,585 | 8/1982 | Eglinton . |
| 4,487,377 | 12/1984 | Perini . |
| 4,487,378 | 12/1984 | Kobayashi . |
| 4,529,141 | 7/1985 | McClenathan . |
| 4,611,638 | 9/1986 | Matumura . |

(List continued on next page.)

FOREIGN PATENT DOCUMENTS

| | | |
|---|---|---|
| 0 331 378 | 9/1989 | European Pat. Off. . |
| 0 498 039 | 8/1992 | European Pat. Off. . |
| 0 580 561 | 10/1996 | European Pat. Off. . |
| 3739341A1 | 6/1989 | Germany . |
| 1213822 | 9/1987 | Italy . |
| 1201220 | 1/1989 | Italy . |
| 2 105 688 | 3/1983 | United Kingdom . |

OTHER PUBLICATIONS

Paper, Film & Foil Converter, "The Art of Winding Good Rolls", by R. Duane Smith, Apr. 1991.

D. Satas "Web processing and converting technology and equipment", 1984, Van Nostrand Reinhold Company, New York, pp. 385, 386, 394–396.

European Search Report, May 25, 1994.

*Primary Examiner*—John M. Jillions
*Attorney, Agent, or Firm*—Leydig, Voit & Mayer, Ltd.

[57] ABSTRACT

There is disclosed a rewinding machine for the production of logs (R) of web material (N) without central winding core. It comprises a first winder roller (11) around which the webmaterial is driven and a second winder roller (13) defining, with the first winder roller, a nip (14) through which the web material passes. A member (21) is also provided which is movable relative to the first winder roller (11) and which is cyclically moved toward the surface of said first winder roller with the web (N) between the member (21) and the roller (11) in order to pinch and thus brake the web material between said member (21) and the first winder roller (11), thereby tearing the web and causing the free edge generated by the interruption of the web material to start winding up on itself.

2 Claims, 11 Drawing Sheets

U.S. PATENT DOCUMENTS 4,783,015 11/1988 Shimizu ..... 242/160.4
4,962,897 10/1990 Bradley .
5,137,225 8/1992 Biagiotti .
5,150,848 9/1992 Consani .
5,368,252 11/1994 Biagiotti .
5,370,335 12/1994 Vigneau .
5,402,960 4/1995 Oliver et al. .
5,505,402 4/1996 Vigneau .
5,505,405 4/1996 Vigneau .

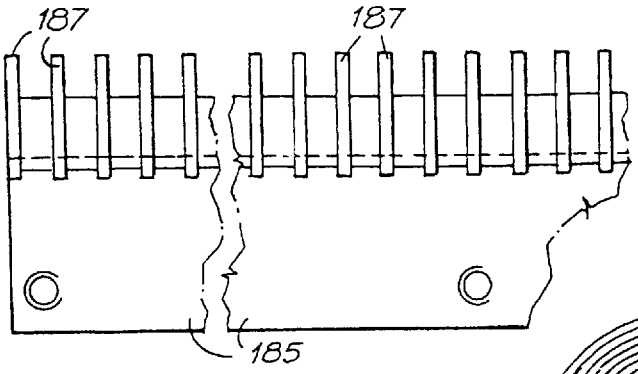
FIG. 15
FIG. 18
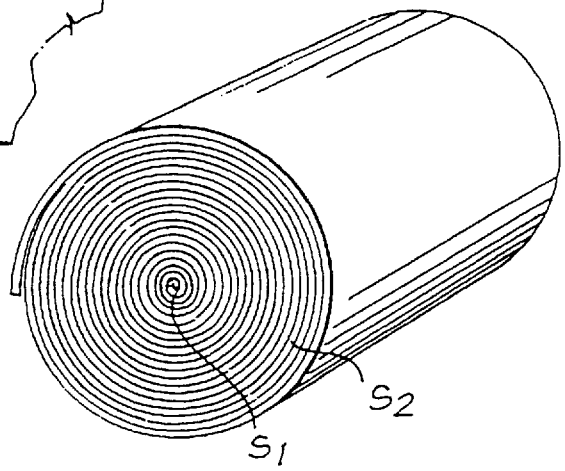
FIG. 17
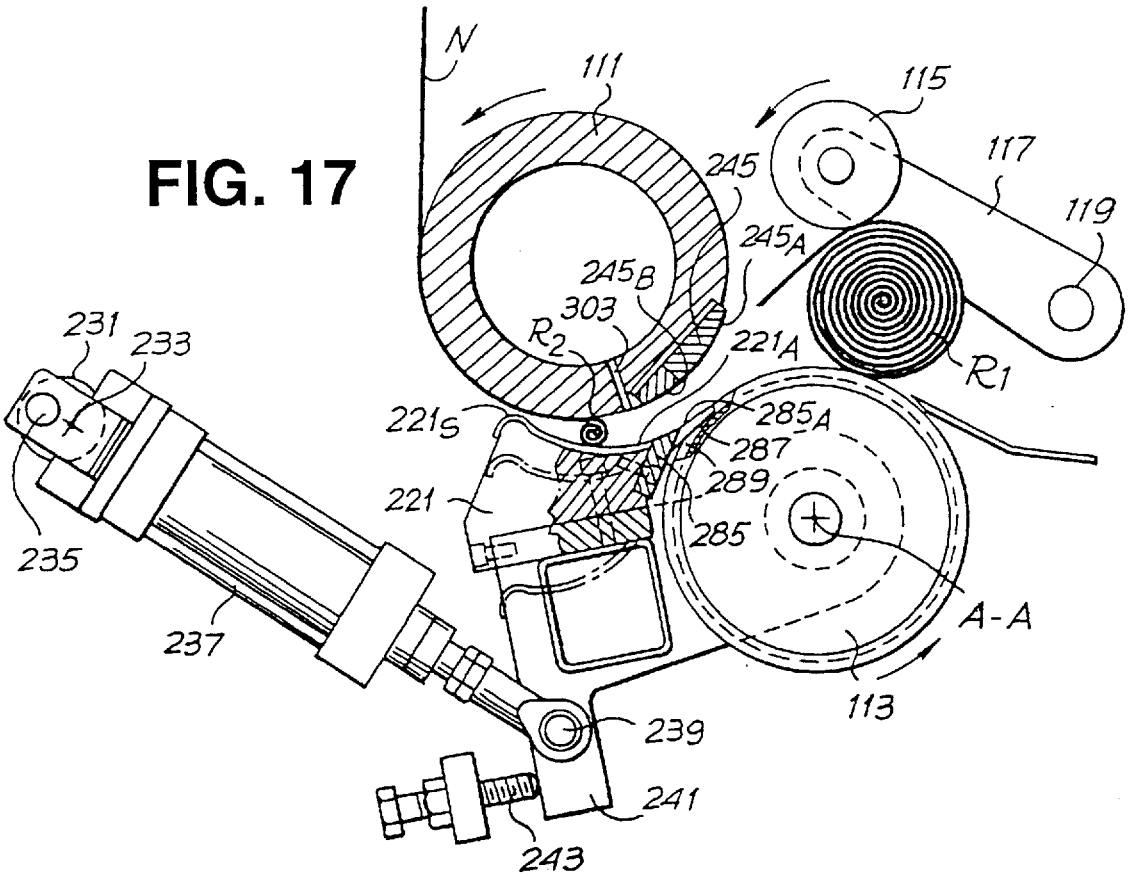

MACHINE AND METHOD FOR THE FORMATION OF CORELESS LOGS OF WEB MATERIAL

This is a divisional of application Ser. No. 08/523,280, filed on Sep. 5, 1995, now U.S. Pat. No. 5,690,296, which was a division of U.S. patent application Ser. No. 08/090,519 filed Jul. 13, 1993, now U.S. Pat. No. 5,639,046.

The invention refers to a rewinding machine for the production of logs of web material, such as paper or the like, which have no central winding core, that is, are devoid of that tubular support commonly used for the formation of the logs. More particularly, the invention refers to a machine of the type including a first winder roller around which the web material is driven and a second winder roller defining a nip with the first winder roller, through which the web material is made to pass.

Such a machine is described, for example, in the Italian Patent No. 1,201,220. In this patent, the second winder roller of the machine is able to be moved close to the first winder roller around which the web material is driven. The contact between the two winder rollers causes the web material to tear between the log being formed and the region of contact between the winding rollers. Said contact further causes starting of the winding of a subsequent log, due to a curling of the free edge of the incoming web material generated by the tearing.

This known apparatus has the drawback that the second mobile winder roller posseses a high inertia which drastically limits the speed with which the operation of tearing the web and starting the next log can be carried out. This adversely affects the paper feeding speed and thus limits the machine's productivity. Moreover, at the end of the winding, the lower winder roller has not only to provide for tearing the web and winding it to start the next log, but also for unloading the just-formed log. This implies difficulties in synchronizing the movements and unloading the log.

Winding of coreless logs is usually carried out, contrary to the apparatus described in the Italian patent No. 1,201,220, by central rewinders in which the web material is wound on central spindles of particular shape which can be subsequently withdrawn after completion of the logs. Such an apparatus is described, for example, in the U.S. Pat. No. 4,487,378. These apparatuses and these traditional methods of winding coreless logs have obviously the drawback of requiring a spindle of special shape that must be withdrawn through an additional operation which adversely affects the production time and thus the plant's productivity.

U.S. Pat. No. 3,250,484 teaches a winder apparatus for web material of large thickness, such as linoleum or similar materials. In this known apparatus, three winder rollers are provided, one of which has a fixed axis, and two of which each have a mobile axis and move gradually away from the roller having fixed axis to allow a log of material to grow in size. At the end of the winding of a log, the winder rollers, which are spaced apart from one another, are made to stop, the log is moved away from the winding region and the rollers are brought close to each other again. In this arrangement, a guide means is inserted into the winding space to begin the winding of the next log. To this end, the web material is guided between the guide means and the winder roller having a fixed axis until its free end comes in contact with the two rollers having mobile axis. As the web material keeps moving forward, the free end thereof starts winding up upon itself within a space defined between the three winder rollers and the guide means. After the formation of the first turns, the winding takes place between the three rollers which are gradually moved apart from each other to leave space for the log being formed, and the guide apparatus is moved away from the rollers.

This apparatus is unsuited for the production of logs of thin material, such as paper or the like, because in order to start the winding of a careless log, the material must have some stiffness or "body" to allow for the formation of the first turns.

It is an object of the present invention to provide a new rewinding machine, which overcomes the drawbacks of the traditional apparatuses.

In particular, it is an object of the invention to provide a rewinder able to function reliably and consistently, even at high web material-feeding speed, which in the paper converting industry is typically in the range of 700 m/min or higher.

Therefore, a rewinder according to the invention is characterized by a member movable relative to a first winder roller and which is cyclically moved toward the surface of said first winder roller in order to brake the web material between said mobile member and said first roller, thereby causing the web to tear and the free end of the web material to wind on itself. The web material is thus torn at the instant of braking by the pinching (unless such tearing was already attained in a different way).

The mobile member which is used to start the new winding is spaced apart and independent of the second winder roller. It, therefore, has very limited inertia and thus allows high accelerations and thus very short, cyclical time for sequential tearing and, consequently, the obtainment of a high production speed. Moreover, as the operation for starting the winding does not occur by means of one of the winder rollers, the latter may be arranged to unload the just-formed log without affecting the operations for starting the winding and possibly tearing the web material.

The mobile member may be also used to cause the tearing of the web material at the end of the winding of a log to start the next winding operation. This may take place by braking or actually pinching the web material between the mobile member and the winder roller. In fact, according to a possible embodiment of the invention, the mobile member is pressed against the surface of the winder roller, thereby pinching the paper. Vice versa, in order to avoid the wear and limit the mechanical stress, it is also possible to shape the surface of the mobile member and the surface of the roller so as to make them interpenetrate and deform the web material interposed therebetween, thereby braking and tearing it.

The tearing of the web material may also take place by other independent procedures not associated with the mobile member. In this case, the latter serves only to start the winding of the next log.

The embodiment in which the member operates also as the tearing of the web material is particularly advantageous because it allows further cutting or tearing devices to be omitted.

Advantageously, the mobile member used to engage the web material, and possibly to tear it at a pre-determined point, and to start winding the next log, is disposed upstream of the nip formed by the first and second winder rollers. The mobile member may have a surface which defines a space, together with the cylindrical surface of the first winder roller, for the initial winding of the log upstream of the nip defined by the winder rollers. In this way, it is possible to start the winding of each coreless log before the latter comes into contact with the second winder roller. Advantageously, the surface of the mobile member (over which the log which is beginning to wind is made to rotate by the rotation of the first winder roller) is tangent to the cylindrical surface of the second winder roller. This allows a regular transit of the log in progress from the curved surface of the mobile member to the cylindrical surface of the lower winder roller.

In a particularly advantageous embodiment, the mobile member is made to move about an axis coincident with the axis of rotation of the second winder roller.

In yet another embodiment of the rewinding machine according to the present invention, the rewinder may be provided with a third mobile diameter control roller which defines a winding space together with the first two winder rollers, wherein the coreless log being formed is completed.

The invention also refers to a method of winding logs of web materials such as paper or the like, to form coreless logs, in which the web material is driven around a first winder roller for the formation of a log and in which, at the end of the winding of a log, the web material is pinched between the surface of the first winder roller and a mobile member, in order to cause the leading edge of the web material to start winding round itself by virtue of the relative motion between the surface of the first winder roller and the surface of the mobile member. The tearing of the web material takes place preferably (but not necessarily) by means of the same mobile member which starts the winding.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIG. 15 is a view of the element forming the terminal portion of the surface of the mobile member.

FIG. 17 is a side view of a modified embodiment.

FIG. 18 is a schematic representation of the product obtained by the rewinder and method according to the present invention.

Figure 1:
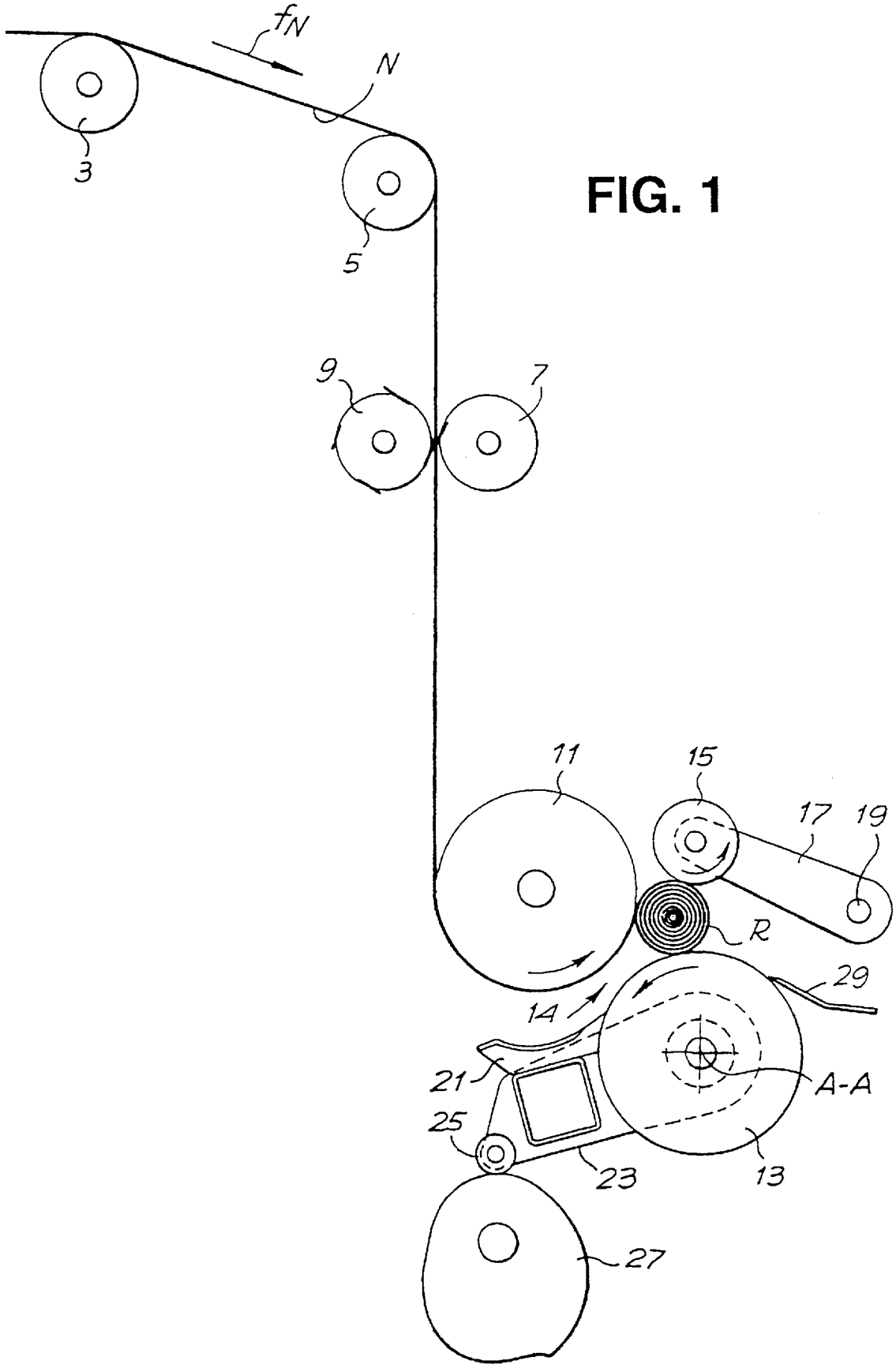
FIG. 1 shows a schematic view of a rewinder according to the invention.

FIG. 1 shows very schematically the basic elements of a rewinding machine, according to the invention, in a first embodiment. N is the web material which is unrolled from a coil of large diameter (not shown) and fed in the direction of arrow fN to the winding region. Numerals 3 and 5 designate rollers for moving the web material N, while 7 and 9 indicate the perforating rollers of a perforation group. The roller 7 is a fixed roller bearing a counter-blade with which a plurality of blades carried by the rotating roller 9 cooperate. The perforation group 7, 9 may be of any well-known type and which is not described herein in more detail. The web material is fed from the perforation group 7, 9 to a first winder roller 11, around which said web is driven. The first winder roller 11 cooperates with a second winder roller 13 which, along with the roller 11, defines a nip 14, through which the web material passes. Downstream of the nip 14, a winding space is defined wherein a log R is formed. The log is in contact with the winder rollers 11 and 13 and with a third mobile diameter control roller 15 as well. The operation of the rewinder, as far as the members described up to now are concerned, is of traditional type and is disclosed, for example, in the British Patent GB 2105688 or in the corresponding German Patent DE 3225518.

Hinged about the axis A—A of the lower winder roller 13 is a mobile oscillating member 21, which is intended to tear the web material at the end of the winding of a log R, and to start the winding of the next log, with no central tubular core. The mobile member 21 is actuated, in the illustrated example, by a rocker arm 23, whose tappet 25 cooperates with a cam 27. However, it will be appreciated that the actuation of the mobile member 21 may also occur otherwise, for example, by an independent, suitably controlled motor, or by other actuator means.

The mobile member 21 is used to pinch the web material between said mobile member and the cylindrical, surface of the first winder roller 11, thereby determining the tearing of the web at a pre-determined point and the starting of the winding of a new log, according to the procedures that will be described hereinafter with reference to FIGS. 2 to 7.

Figure 2:
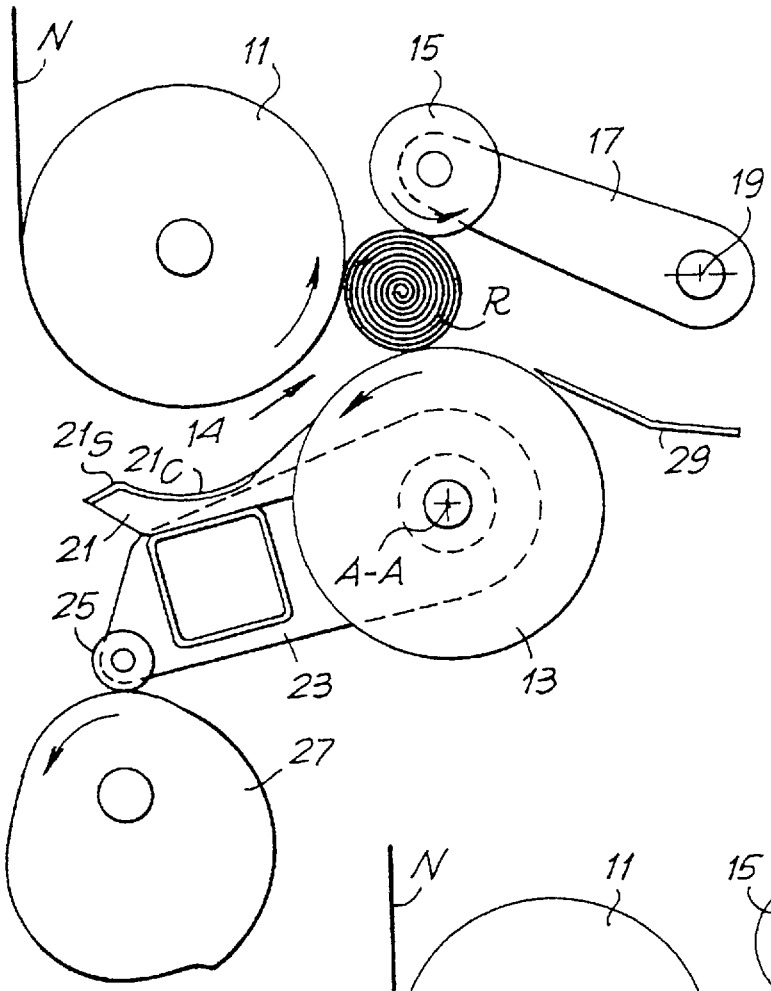
FIGS. 2 to 7 show subsequent steps of the winding cycle, FIG. 4A being an enlargement of the region IVA of FIG. 4.

Shown in FIG. 2 is an intermediate step of the winding of a coreless log R. In this drawing, the log R is in contact with the three rollers 11, 13 and 15, which rotate in counter-clockwise direction. The peripheral speed of these rollers is substantially equal to the feeding speed of the web material N. The mobile member 21 is at a lowered position with respect to winder roller 11, so as not to affect the advancement of the web material N.

Figure 3:
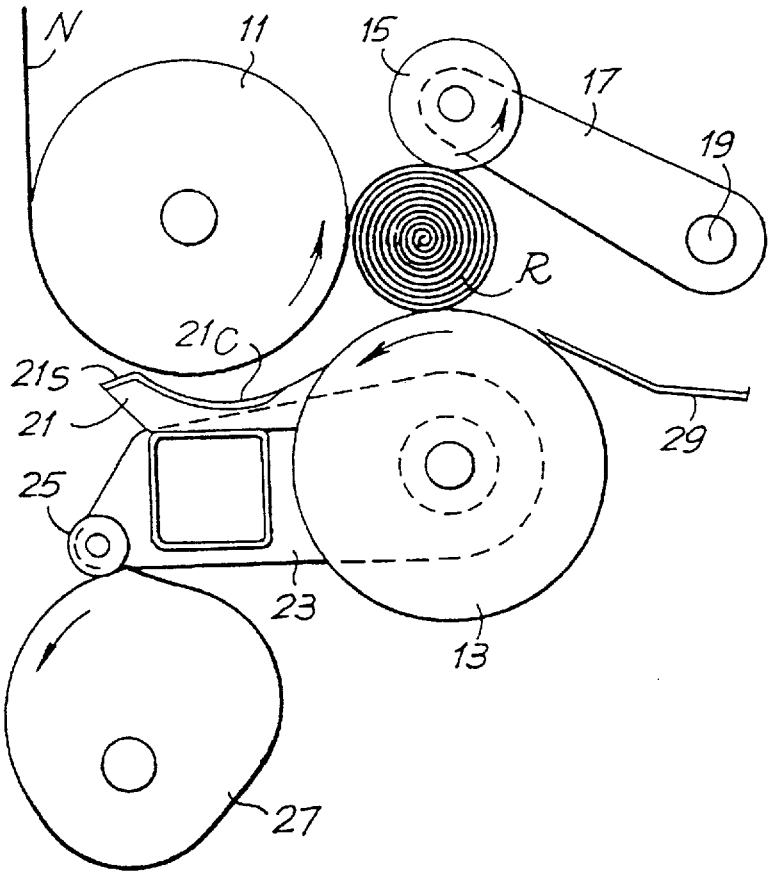

When the log R has reached the predetermined size (being defined as a function of the diameter and/or the length of wound web material), the mobile member 21 is moved close to the first winder roller as shown in FIG. 3. This movement is obtained, as illustrated in the drawing, by means of the cam 27 which rotates in counter-clockwise direction and performs one revolution on every winding cycle, that is to say, for each log R being formed. In the arrangement shown in FIG. 3, the surface 21S of mobile element 21 is very close to the web material N, but does not yet touch it.

Figure 4:
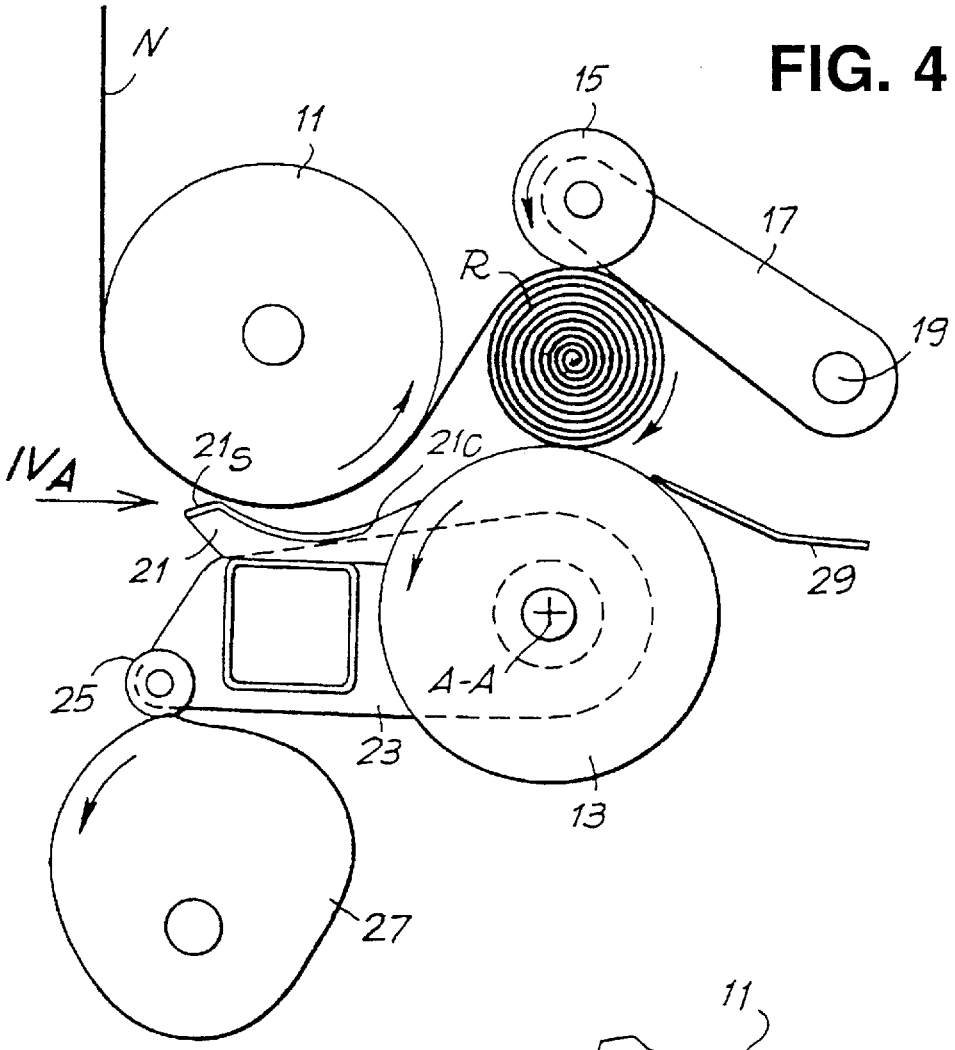
Figure 4A:
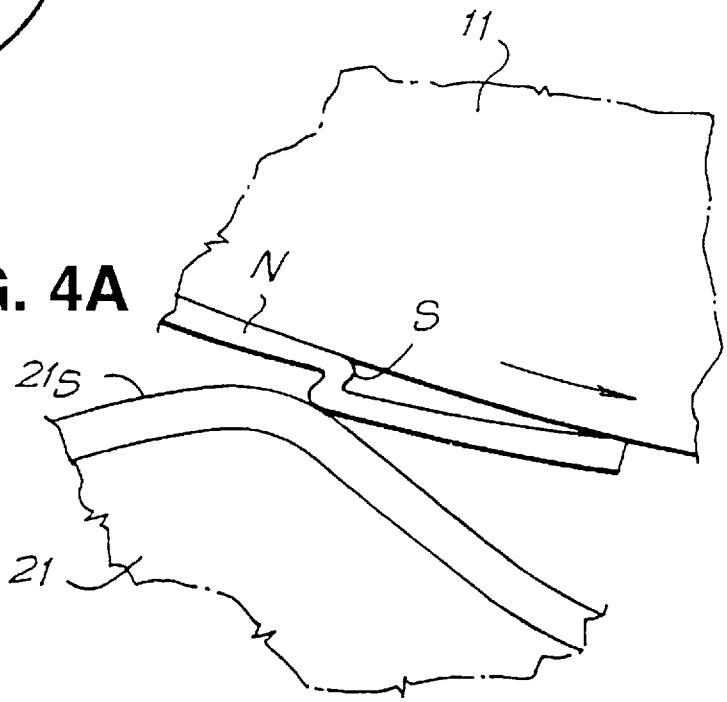

At the moment when the web material N has to be torn and the winding of the next log has to start, the mobile member 21 is abruptly brought from the position of FIG. 3 to the position of FIG. 4, in which the surface 21S of the mobile member 21 is in contact with the web material. Here the web is pressed, i.e., pinched, between said surface 21S and the cylindrical surface of the first winder roller 11. This pinching action causes firstly the tear of the web material along a perforation line which lies between the point of contact of the member 21 with the web material and the log R just formed. Secondly, the pinching action of the web material between the surface 21S and the surface of the winder roller 11 causes the leading portion of the web material, i.e., that portion close to the section where the tearing has taken place, to curl. This is shown in details in the enlargement of FIG. 4A.

Once the web material has formed a loop or turn S (see FIG. 4A), the rotation of the winder roller 11 and a slight separation of surface 21S of mobile member 21 from the cylindrical surface of said winder roller 11 cause the start of the winding of the next log. The latter begins to form in a winding space or channel which is defined between the cylindrical surface of the winder roller 11 and the concave surface 21C of the mobile member 21 (see FIG. 5). The curvature of the surface 21C is so chosen as to allow the log in progress to increase its diameter by keeping the log in contact with the surface 21C and the cylindrical surface of the first winder roller 11. In some cases, the surface 21C may be flat, as in the case when it has a limited development.

Figure 5:
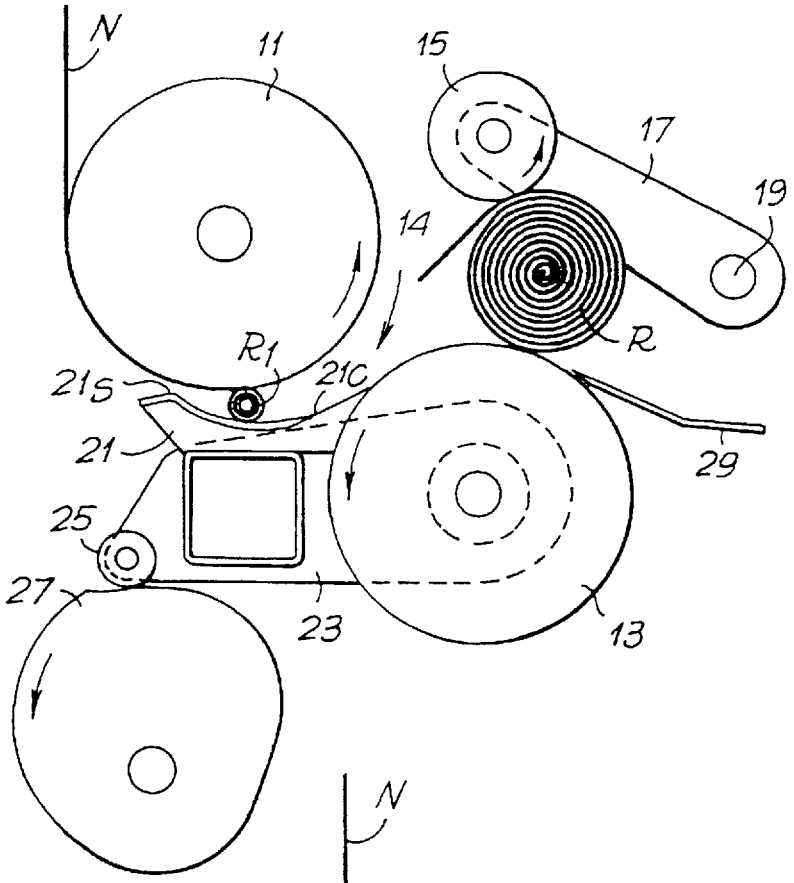

The advancement of the new log in the course of formation (shown at R1 in FIG. 5) takes place by its rolling over the surface 21C, owing to the rotation of the winder roller in a counter-clockwise direction. The advancement speed of the new log R1 is equal to half the feeding speed of the web material N. As shown in FIG. 5, in this condition, the mobile member 21 is at a standstill and slightly spaced apart from the cylindrical surface of the winder roller 11, the same condition as is shown in FIG. 3, to allow for a free advancement of the web material.

Figure 6:
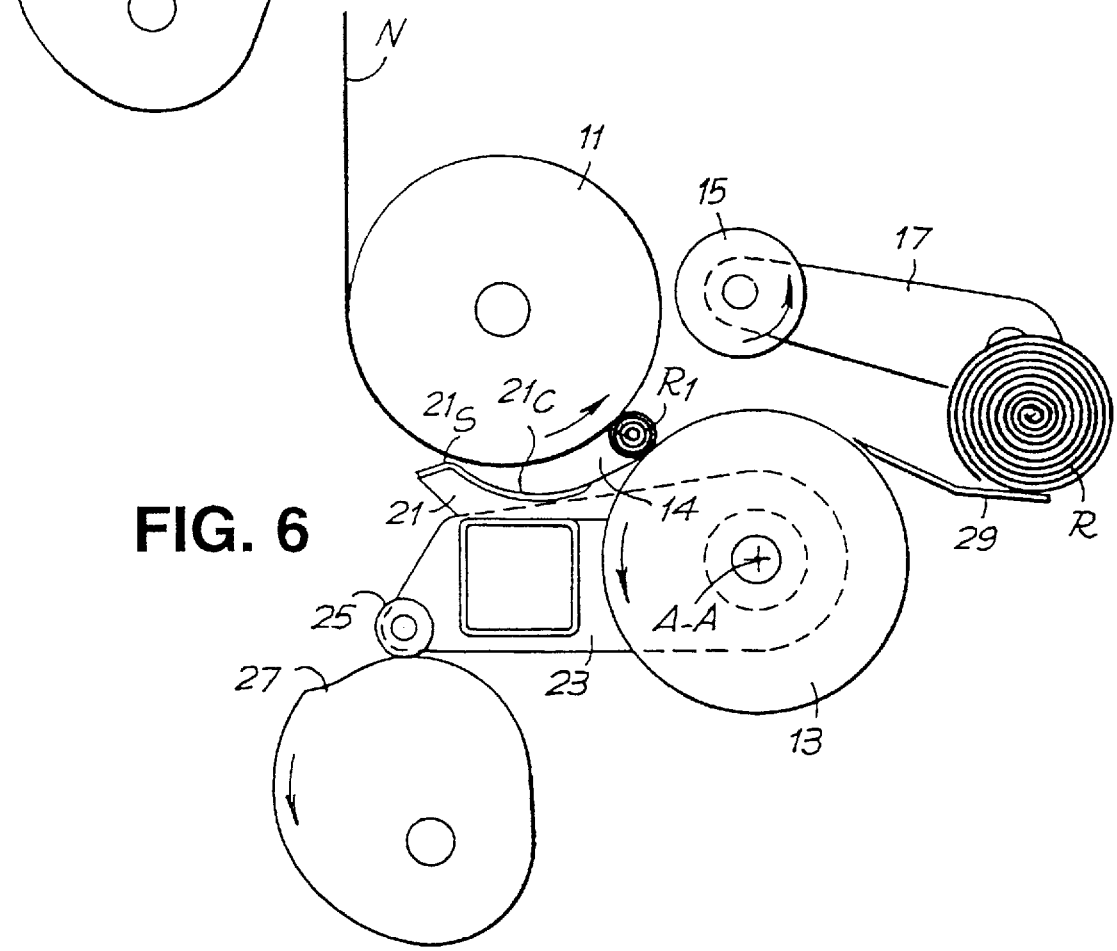
Figure 7:
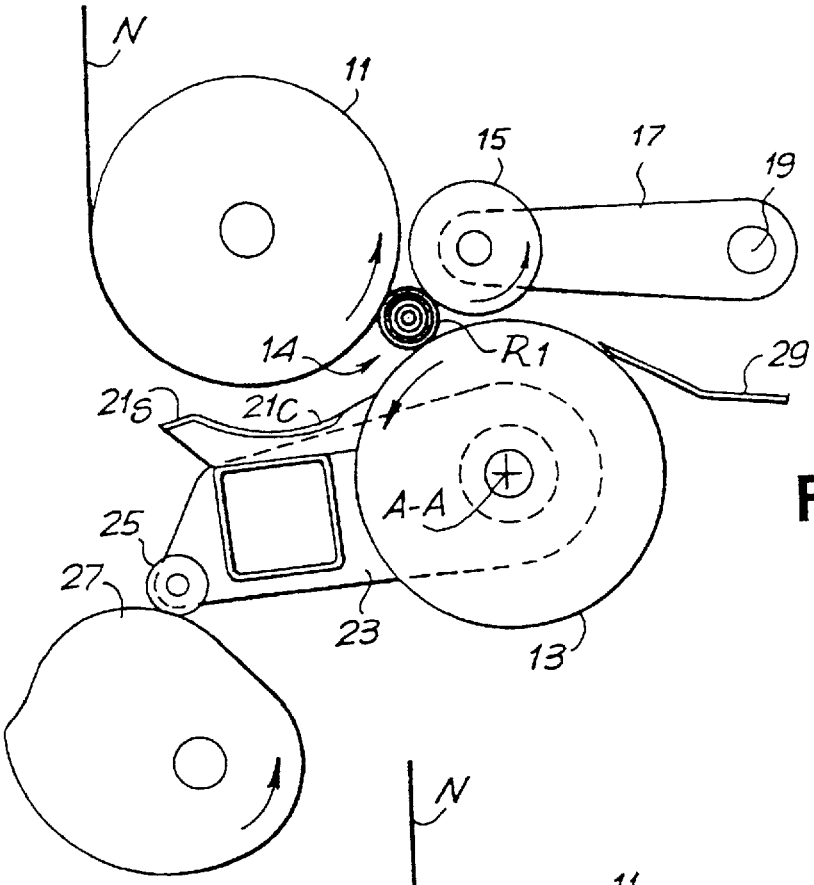

The surface 21C is so shaped as to be tangent to the cylindrical surface of the second winder roller 13, so that the log R1 in the course of formation is able to shift smoothly and unstressed from the position in which it is in contact with the surface 21C to the position in which it is in contact with the cylindrical surface of the second winder roller 13, thereby taking up the position shown in FIG. 6. From this position, the log R1 is made to advance in the winding space defined by the winder rollers 11 and 13 and the diameter control roller 15, which space has been cleared of the log formed in the preceding cycle and unloaded along the discharge ramp 29.

The discharge of the completed log R and the transit of the new log R1 through the nip 14 into the winding space defined by the three rollers may take place by virtue of a difference in the speed. In particular, the discharge of the log R may take place by either accelerating the diameter control roller 15, or decelerating the second winder roller 13, or even by the combined effect of these two speed variations. If the winder roller 13 is decelerated, such action may also serve to complete the introduction of the small log R1 in the course of formation, through the nip 14, into the winding space defined between the rollers 11, 13 and 15. These procedures for the unloading of the finished log or for the insertion of the log in the course of formation into the winding space are known and described, for example, in the U.S. Pat. No. 4,487,377. There is also the possibility of inserting the log R1 in the course of formation by virtue of a constant difference of speed between the winder rollers 11 and 13, such as described in EP-A-O 331 378. In this case, provision may also be made for changing the center distance between the rollers 11, 13 during the winding.

To facilitate the discharge of the formed log R, it is also possible to use a mobile ramp 29 which is temporarily moved close to the log R.

When the log R1 has come out of contact with the surface 21C, the mobile member 21 may be moved farther away from the winder roller 11 to the position of FIG. 2, so as to prevent it from interfering with the advancement of the web material N.

As above mentioned, the mobile member 21 may be operated, instead of by the cam 27, by an independent motor. When using a cam 27, the latter may be driven via a transmission whose motion is derived from the central motorization of the machine or from an independent motor which directly drives the shaft on which the said cam 27 is keyed.

The surface 21S of the mobile member 21 that comes in contact with the web material may be coated with an elastically yielding material in order to improve the formation of the turn or loop S upon the beginning of the winding for the formation of each log. As an alternative to, or in combination with, the surface of the winder roller 11 may be coated with yielding material such as rubber. The beginning of the winding of each log may be further facilitated by coating the surface 21S and/or the cylindrical surface of the first winder roller 11 with a material having a high coefficient of friction.

In the illustrated preferred embodiment, the rewinding machine is provided with a perforation group 7, 9. This is not strictly required but, when present, it is desirable that the oscillating motion of the mobile member 21 be in synchronism with the motion of the perforator 7, 9, so that the contact between the mobile member 21 and the roller 11 will occur at a limited distance from a line of perforation downstream of the contact region, so that the tear takes place on said line of perforation.

In the embodiment so far described and illustrated in FIGS. 1 to 7, the web material N is torn by virtue of the cooperation between the mobile member 21 and the winder roller 11. This is not, however, strictly necessary, even if particularly advantageous inasmuch as it allows the construction of a simpler machine.

Figure 8:
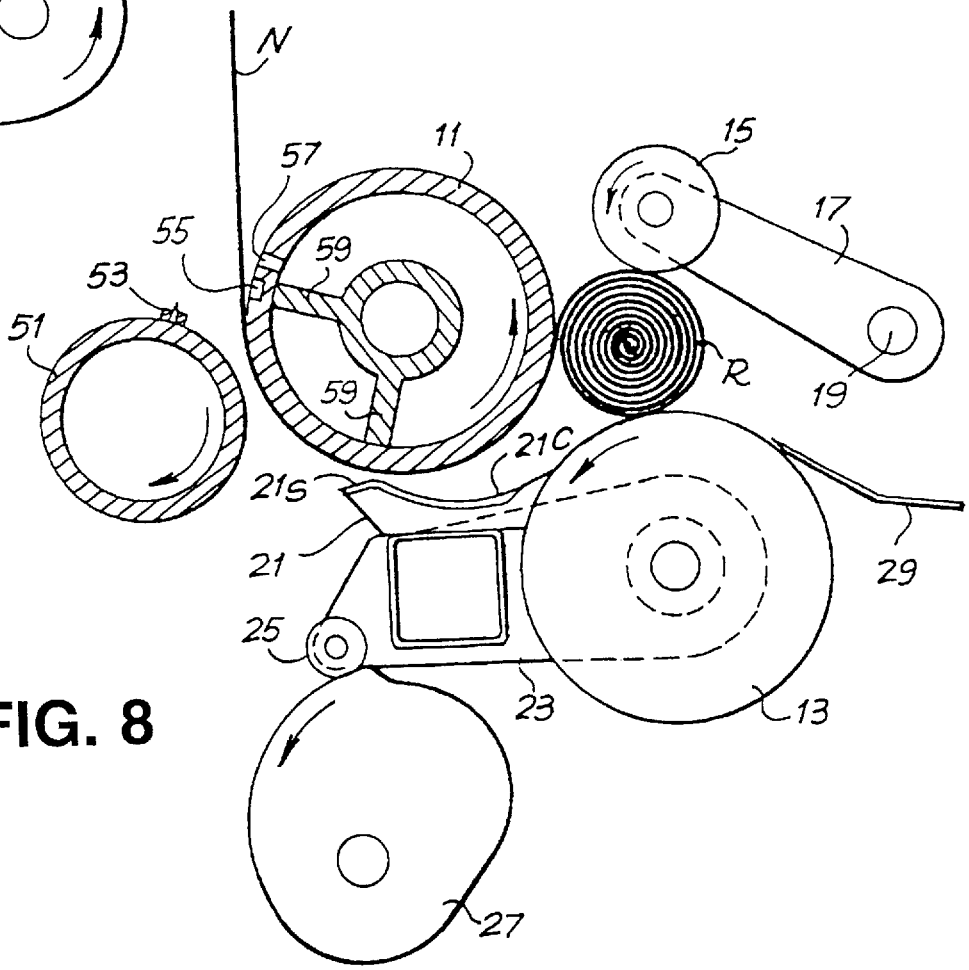
FIG. 8 shows a schematic embodiment in which the web material is interrupted and torn by an additional cutting device located upstream of the mobile member.

FIG. 8 shows a feasible embodiment of the machine according to the invention, in which the web material N is cut or torn upstream of the mobile member 21. Like numbers indicate parts equal or corresponding to those of the embodiment of FIGS. 1 to 7. With respect to the latter, the embodiment of FIG. 8 has a cutting means which, in the particular case illustrated in FIG. 8 (not to be considered in a limitative sense) has a cutting cylinder 51 with a blade 53 or other equivalent severing member. The cylinder 51 rotates in synchronism with the roller 11 and, at predetermined moments, the blade 53 may be brought into cooperation with a channel-shaped counter-blade 55 formed in the surface of roller 11. This may be accomplished either by moving the cylinder 51 close to roller 11, as described, for example, in the U.S. Pat. No. 4,487,377 (which refers to a different type of rewinder) or by removing the blade 53 from a seat formed in the cylinder 51, such as in the Italian patent No. 1,213, 822. The content of both the above-mentioned patents are incorporated in the present description.

In the present case, a series of suction holes 57 are provided on the roller 11 to hold at least the leading edge of the web material after the cut thereof and move it to the region where the mobile member 21 operates. Indicated by 59 are dividing walls inside the roller 11 which define a vacuum chamber.

Figure 9:
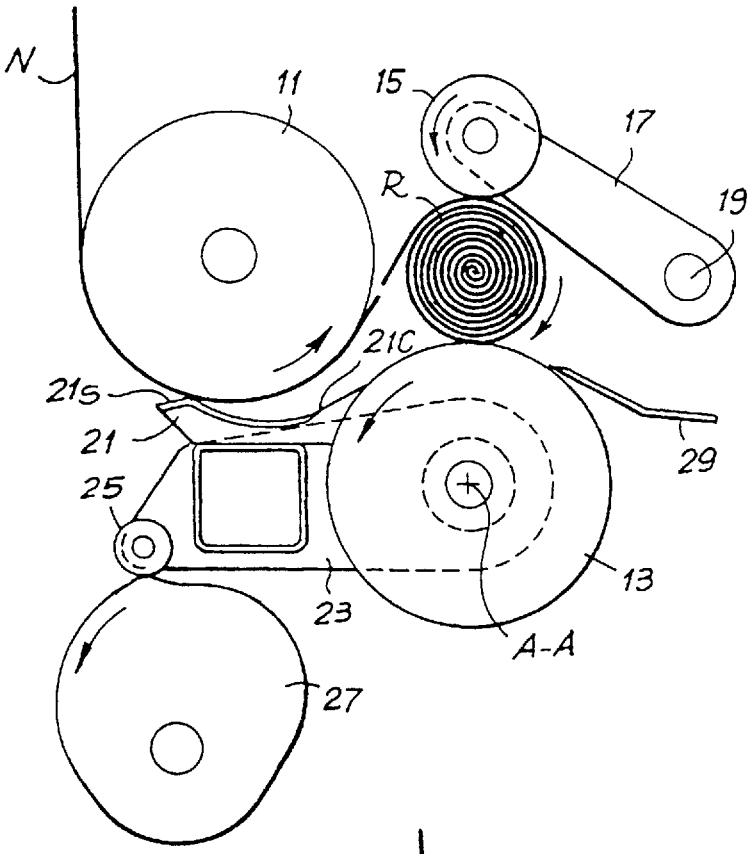
FIG. 9 shows the web material tearing step operated by an acceleration of a diameter control roller.

The separation of the web may also occur with other methods. For example, provision may be made for tensioning the material N to rupture by accelerating the diameter control roller 15. The tearing occurs in this case as shown in FIG. 9, in correspondence of a perforation line. The tearing may be made easier by bringing the member 21 in contact with the material N.

Figure 10:
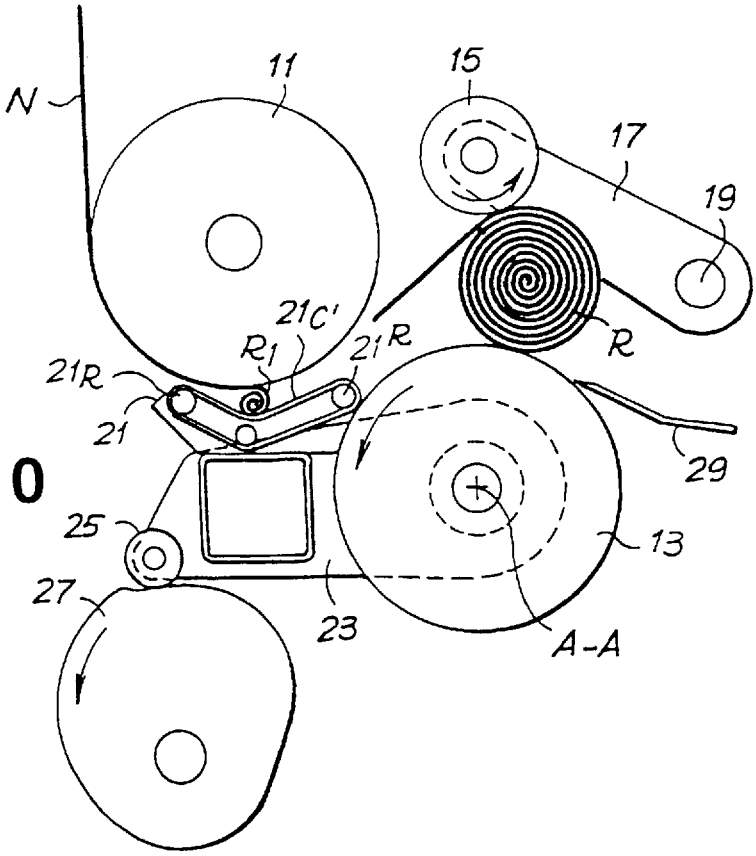
FIG. 10 shows another embodiment of the surface of the mobile member.

The surface 21C of the mobile member 21 may be constructed in such a way as to fit the size of the log R which is being formed within the channel defined by the surface 21C and the roller 11. This may be achieved by a layer of a yielding material applied along the development of the member 21 and forming the surface 21C, or by using a system with a flexible belt member or the like. This embodiment is roughly illustrated in FIG. 10, in which the surface 21C' is formed by a belt moving around two rollers 21R. Such an arrangement prevents the belt 21C' from sliding (by being anchored, for example, to one of rollers 21R), but it enables the same belt to be deformed by the force exerted thereon by the log R1 in the course of formation. Instead of an endless belt, an open belt may be used having an end anchored to a fixed point and the other end anchored, for example, to an elastic restraint.

In the above illustrated embodiments reference has been made to a roller 11 having an external continuous surface onto which the surface 21S of the mobile member 21 is pressed for pinching the web material. This type of operation implies a repeated mechanical stress due to the direct mechanical contact between the mobile member 21 and the winder roller 11.

Figure 11:
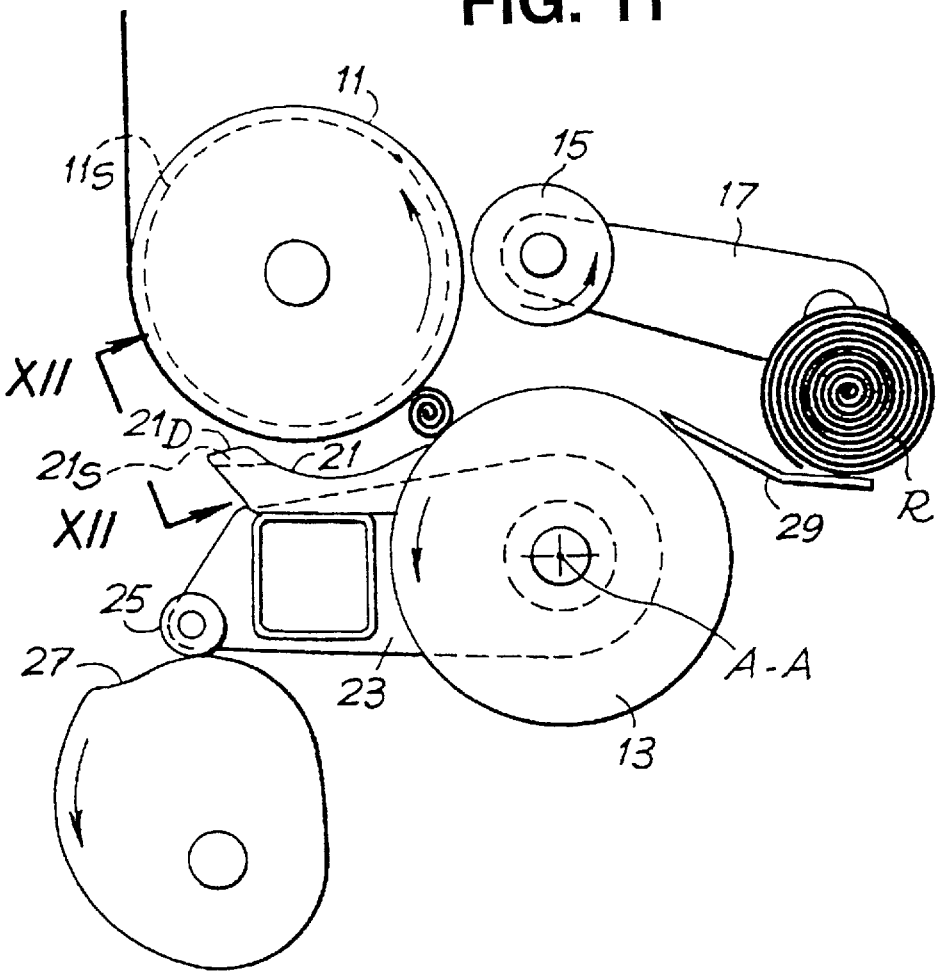
FIG. 11 shows a modified embodiment.
Figure 12:
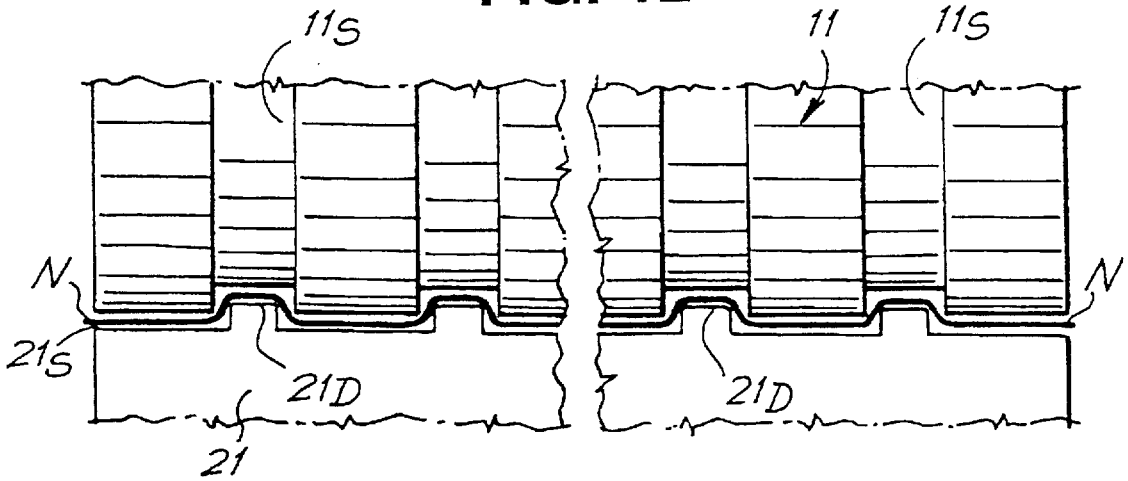
FIG. 12 shows a partial view taken on line XII—XII of FIG. 11.

To avoid such repeated mechanical action and thus reduce stress and wear, it is possible (according to a further embodiment of the invention shown in FIGS. 11 and 12) to provide the roller 11 with a plurality of annular grooves 21S. The surface 21S of the mobile member 21 is in turn provided with a plurality of projections 21D disposed opposite the slots 11S of roller 11. When the winding far the formation of a new log is to be started, the mobile member 21 is moved close to the winder roller 11 so that the projections 21D will enter, at least partially, into the annular slots 11S, as shown in FIG. 12. This causes a deformation of the web material N in the transverse direction (i.e., parallel to the axis of the roller 11) as shown in FIG. 12, and thus a friction action on the same material. The friction is sufficient to cause the web material to tear along a line of perforations (unless such tearing is already carried out through a different procedure), and the free edge of web material to curl thereby beginning to wind on itself for producing a new log. To increase the grip effect on the web material, both the surfaces of the projections 21D and of roller 11 are, in this case, made up of a material having high coefficient of friction.

FIGS. 13 to 16 show a modified embodiment.

Figure 13:
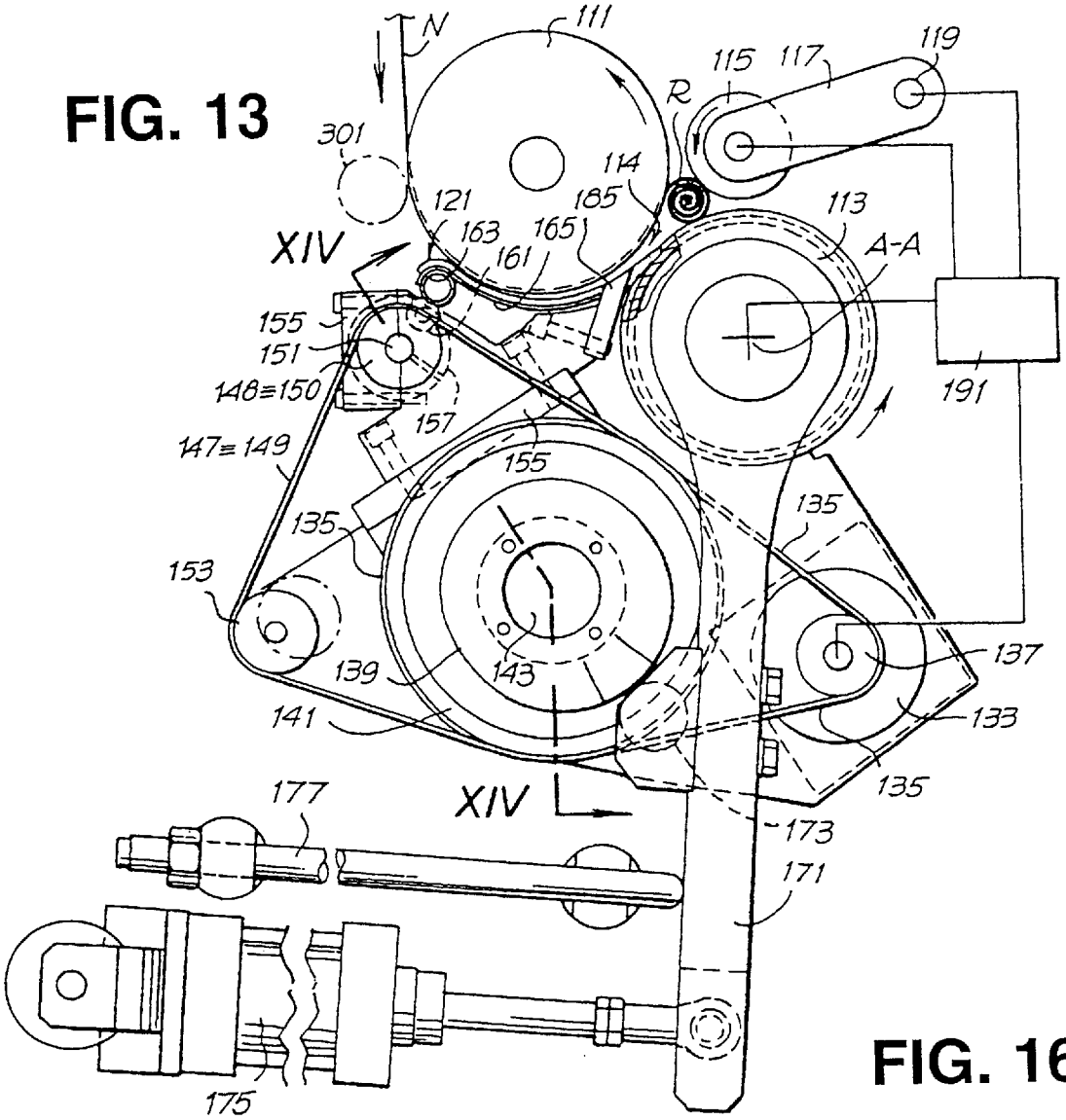
FIG. 13 is a side view partially in section of an improved embodiment of the rewinder according to the invention.
Figure 14:
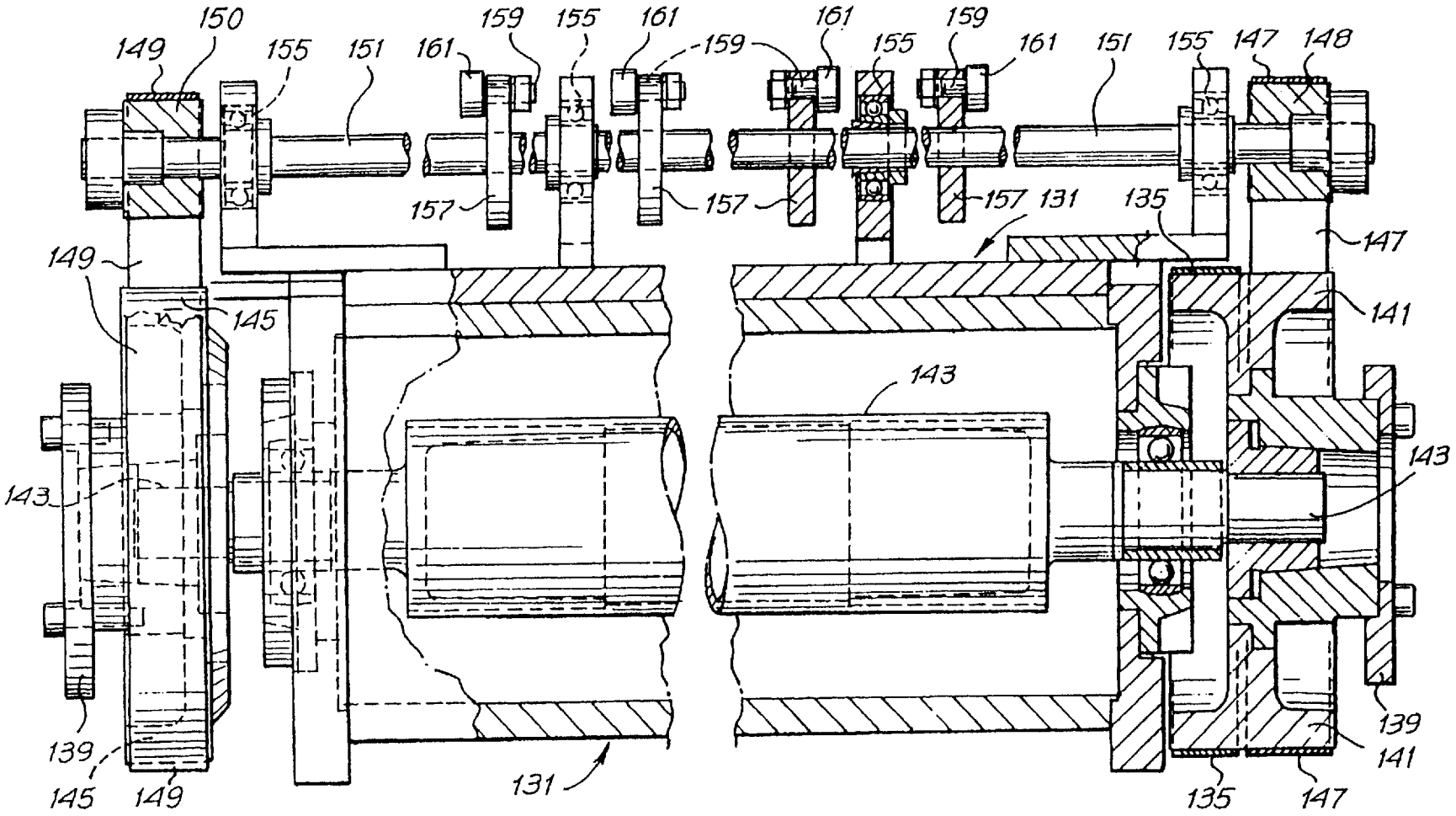
FIG. 14 is a section taken on line XIV—XIV of FIG. 13.

Referring first to FIGS. 13 and 14, numeral 111 indicates a first winder roller around which the web material N to be wound up to form logs R is moved. Numeral 113 indicates a second winder roller defining, along with the first winder roller, a nip 114. The two winder rollers 111 and 113 both rotate counter-clockwise (see FIG. 13). Numeral 115 indicates a third roller, also rotating in counter-clockwise direction and movable in order to allow the diameter of the log R in the course of formation to be increased and controlled. The third roller 115 is carried by an arm 117 pivoted at 119 to the structure of the machine.

Numeral 131 generally indicates an oscillating unit pivoted about the axis of rotation A—A of the second winder roller 113. Unit 131 carries a motor 133 which, via a belt 135 driven around a driving pulley 137, rotates a dual cam 139. More in particular, and as shown in sectional view in FIG. 14, the belt 135 is driven around a second pulley 141 which is keyed to an end of a shaft 143. Fixed to pulley 141 is a first cam 139. Keyed to the opposite end of shaft 143 is a second pulley 145 of smaller diameter which is fixed to a second cam 139 having the same profile as the first cam. The profile of the dual cam 139 is shown in side view in FIG. 13. Driven by two pulleys 141 and 145 are corresponding belts 147, 149 which transmit the motion from the shaft 143 to a shaft 151 via further transmission pulleys 148, 150 keyed on the shaft 151. The belts 147 and 149 are further guided around two idler pulleys 153, only one of which being shown in FIG. 1.

The shaft 151 is supported by a plurality of spaced supports 155, carried by the unit 131. Keyed an the shaft 151 between the supports 155 are disks 157 each of which bears a pivot 159 on which a small roller 161 is idly supported. The small rollers 161 cooperate with a steel tubular member 163 fixed to a sheet 165 made of light and flexible material such as carbon fibre. Numeral 121 generally indicates the member formed by tubular member 163 and lamina 165. Fixed to the latter is a lining 167 of elastically yielding material such as rubber or the like. Generally indicated by 121A is a curved surface defined by the mobile member 121 which forms, along with the cylindrical surface of the winder roller 111, a channel of increasing cross-section wherein the winding for the formation of each log is started, according to the procedures described below.

A pair of arms 171 are pivoted at the axis A—A about which the winder roller 113 rotates and the oscillating unit 131 swings. FIG. 13 shows only one arm 171, the other being symmetrically disposed on the opposite side of the machine. Mounted on each arm 171 is an idle small roller 173 forming the tappet of the respective cam 139. Under normal operating conditions, the arms 171 are pushed by a cylinder-piston system 175 against an adjustable abutment 177 located on the machine frame, i.e., fixed relative to the axes of rotation of the winder rollers 111, 113. By activating the adjustment means of the abutment 177, it is possible to change the interference between the surfaces of the roller 111 and the mobile member 121.

When the rewinder is in operation, the rollers 111, 113 and 115 rotate in the same direction to keep rotating the log R in the course of formation. Upon completion of log R, the mobile member 121 is moved close to the surface of the winder roller 111 on which the web material is driven, the latter being pinched—or anyway braked—between the surface 121A of the mobile member 121 and the surface of the roller 111, thereby causing the web material to tear between the pinching point and the completed log R, and the free end of the so torn web material to curl up and start winding on itself to form the new log.

The procedures with which the above operations are carried out are similar to those illustrated in detail in the previously described embodiment of FIGS. 1–7 and will not be described again in greater detail.

Differently from what is provided in the preceding embodiment, however, the approaching movement between the mobile member 121 and the roller 111 may be performed in two steps. In fact, during the winding for the formation of a log R the motor 133 is kept stationary. When a given amount of web material has still to be wound on the almost completed log, the motor 133 is activated at a speed proportional to that of the machine, and its motion is transmitted to the dual cam 139 via the belt 135. The cam profile is such as to cause a movement of the unit 131 about the axis A—A and thus a gradual approach of the mobile member 121 to the surface of roller 111. For every winding cycle, i.e., during the formation of each log R, the cam 139 performs a complete revolution at a speed proportional to that of the web material and then stops, waiting for the following cycle, so that during each winding cycle the mobile member 121 moves close to and, afterwards, away from the roller 111. However, the movement obtained through the dual cam 139 does not bring the surface 121A sufficiently close to the surface of roller 111 to cause the tear of the web material and the subsequent winding thereof. In fact, while the rotation of the dual cam 139 causes a gradual approach of roller 111, the motion of motor 133 is transmitted also to the shaft 151 and thus to the small rollers 161 which rotate about the axis of shaft 151 and move the elastic sheet 165 into an oscillating motion relative to the unit 131. The maximum approach between the surface 121A and the cylindrical surface of roller 111 takes place when the approaching motion provided by the dual cam 139 adds up to the approaching movement of the sheet 165, the latter being caused by the small rollers 161 driven into rotation by the shaft 151.

As clearly shown in FIGS. 13 and 14, the diameter of pulleys 141, 145 is a great deal larger (typically four times greater) than the diameter of the driving pulley 137 which is, in turn, of a diameter approximately equal to the pulleys 148, 150 keyed on the shaft 151. This means that upon every revolution of the dual cam 139 and, therefore, over each winding cycle for the formation of a log R, there occurs an approaching oscillatory movements of the unit 131 towards the roller 111 and a certain number of fast oscillatory movement of the mobile member 121 with respect to the unit 131. When the pulleys 133 and 148, 150 have the same radii, and the pulleys 141, 145 each have a radius four times as much that of pulley 133, there occurs an oscillation of the unit 131 and four oscillations of the mobile member 121 upon every winding cycle. The oscillation movements are so phased to each other that only one of the fast oscillation movements of the mobile member 121 comes to temporarily coincide with the point of maximum approach of unit 131 relative to roller 111.

Therefore, the above described apparatus allows the approaching movement of the mobile member 121 towards the winder roller 111 to be split into two movements, the first one of slow and coarse approach at low speed (controlled by the dual cam 139) and the second one of fast and fine approach (controlled by the small rollers 161). This makes it possible to drastically reduce the involved inertia, since the mobile member 121, which is the one provided with the cyclic motion having higher frequency, is formed by elements of greatly reduced mass. Vice versa, the heavier members which form the unit 131, are provided with movements four times slower and, consequently, with minor inertial stresses.

Figure 16:
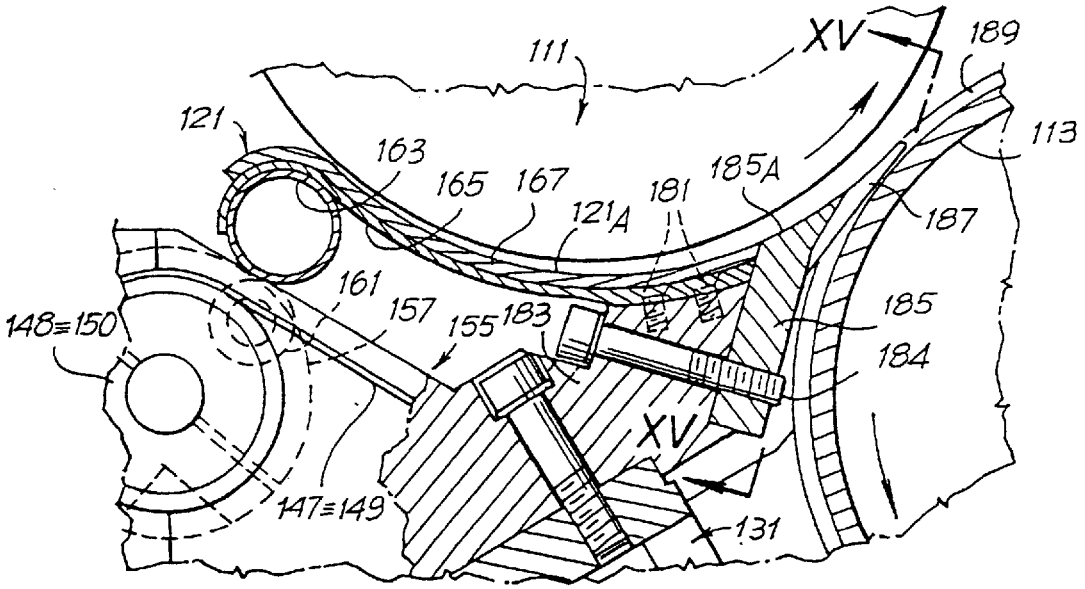
FIG. 16 is an enlarged detail of the nip region between the winder rollers of FIG. 13.

Referring now to FIGS. 15 and 16, it can be seen that the lamina 165 is anchored, through a set of screws 181, to the suitably shaped front part 183 of the supports 155 which are fixed to the mobile unit 131. Also fixed to the same part 183 by means of screws 184 is a comb-like element 185 which is provided with a plurality of teeth 187 which extend inside annular grooves 189 of the winder roller 113. FIG. 15 shows the comb-like element in a separate view according to arrow F in FIG. 13, in which the teeth are indicated by 187. The comb-like element further has a surface 185A which makes up the extension of the surface 121A of the member 121.

The comb-like element 185 provides, therefore, a smooth rolling surface devoid of projections for the log in the course of formation which is thus able to roll easily and smoothly from the surface 121A of the mobile member 121 onto the cylindrical surface of the roller 113. Moreover, if during the passage from the surface 121A to the surface of the roller 113, the log under formation is not perfectly parallel to the axes of the winder rollers 111 and 113 (which is likely to happen as no provision is made for a central core on which to wind the web material), the comb-like element 188 allows to automatically align it when it leaves the surface 121A, 185A onto the surface of roller 113. In fact, should the log have its axis inclined relative to the axis of roller 113, the most advanced portion of the log would enter in contact with the roller 113 in advance with respect to the most retracted portion, which is still in contact with the surface 185A. On the other hand, since the cylindrical surface of the roller 113 is provided with a speed almost equal to that of the surface of the roller 111, while the surface 185A is at standstill, there occurs an automatic slowing down of the most advanced portion of the log. The various portions of the log will acquire the same speed of translation along the nip defined by the rollers 111 and 113 only when the same log will have its axis perfectly parallel to the axes of the rollers 111 and 113.

This alignment action of the log being formed, with respect to the axes of the winder rollers, may be increased by suitably modifying the rotational speed of the second winder roller relative to the rotational speed of the first winder roller. For example, by using a central control unit 191, schematically represented in FIG. 13, it is possible to cause a gradual deceleration of the winder roller 113, with respect to the winder 111, so as to cause the log under formation to pass through the nip defined between the rollers. If the deceleration has begun with some delay with respect to the moment in which the log reaches the transit region between the comb-like element 185, 187 and the surface of the winder roller 13, there will be a moment in which the log tends to remain stationary at the point in which it comes in contact with both the winder rollers 111, 113. The alignment of the log is obtained on this very moment, in case the log is not perfectly aligned with the axes of the winder rollers. In this case, provision is made for moving the rollers 111, 113 a way from each other.

Figure 19A:
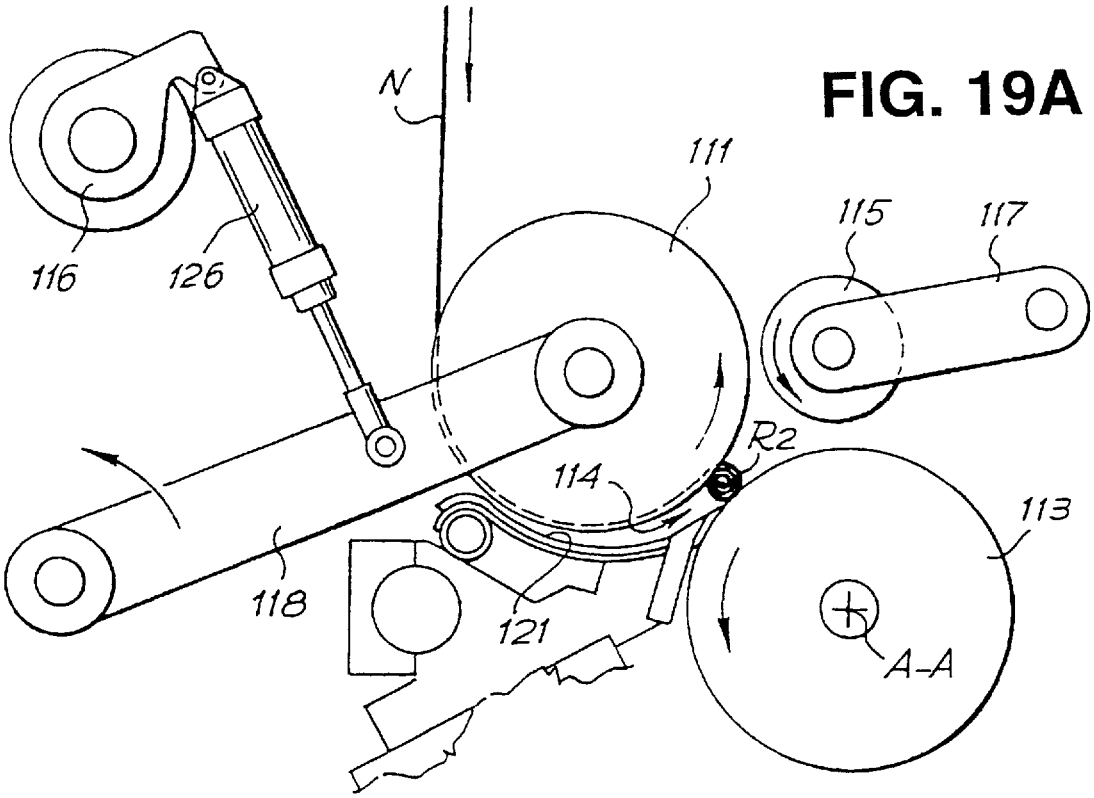
FIGS. 19A and 19B show two subsequent positions taken by the winder rollers in an embodiment in which the center distance between said rollers is variable.
Figure 19B:
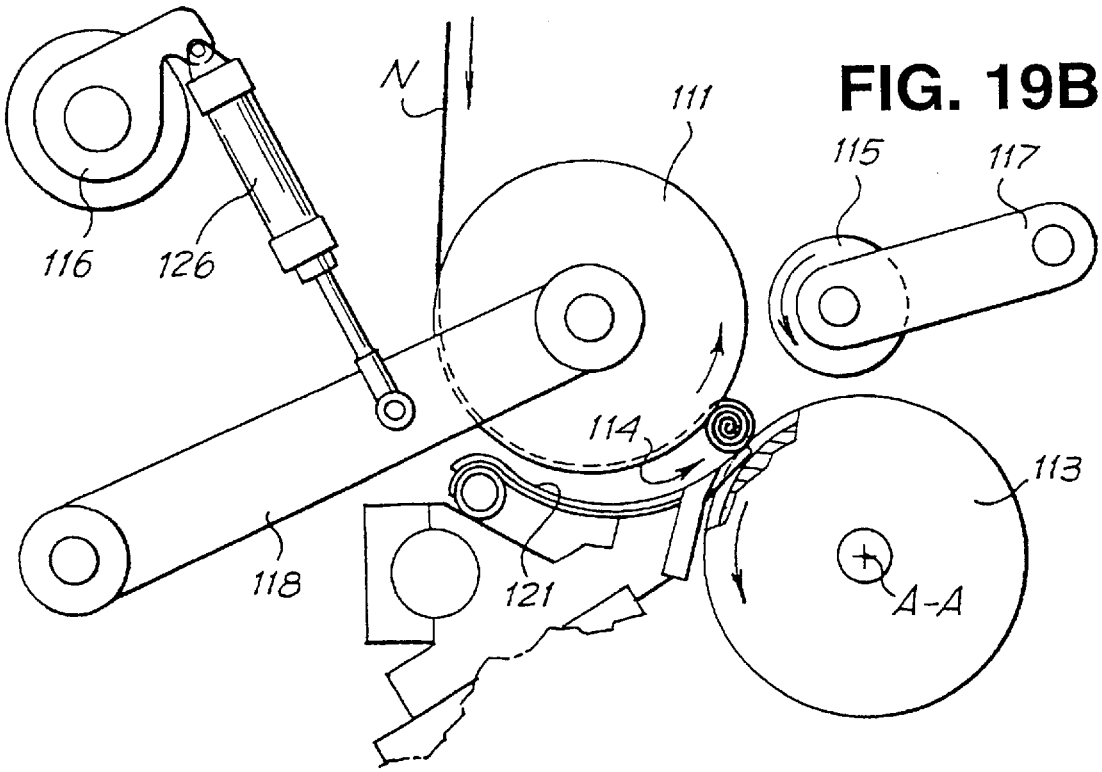

The possibility of mutually moving the winder rollers 111, 113 from and towards each other, may also be provided regardless of the procedures by which the rotational speed of the roller 113 is controlled. For example, provision may be made either for a constant or variable speed between the rollers 111, 113, without stopping the log (that is, with a gradual and continuous advancement of said log between the rollers 111, 113), through a movement of gradual removal of the axes of the rollers 111, 113. The removal movement may be controlled by an actuator or be obtained by virtue of elastic yielding caused by the increase of the log in the course of formation. FIGS. 19A and 19B illustrate a modified embodiment in which the winder rollers 111, 113 are shown at two subsequent positions during the step of transit of log R2 within the nip 114.

In this embodiment rollers 111 and 113 are gradually spaced apart by means of an actuator 116 which is connected to a pair of oscillating arms 118 carrying the roller 111, only one of which is shown in the Figure, the other being symmetrical.

An elastic element 120 connects the actuator 116 to the arm 118. It is evident that the controlled movement of mutual retraction and reapproaching of the rollers 111, 113 may be obtained also by displacing the roller 113 relative to roller 111, the axis of the latter remaining stationary, but this implies the drawback of having to displace also the oscillating members about the axis of roller 113.

The mutual displacement of the rollers is of an amount sufficiently limited as not to give rise to negative effects on the tension of the web material even when the moving roller is roller 111.

The central control unit 191 may also serve for controlling: the lifting and lowering movement of the mobile diameter-control roller 115; the possible acceleration of said roller to cause the unloading of the completed log; the motor 133 for controlling the oscillation of the unit 131; and possibly the actuator which determines the mutual spacing apart of rollers 111, 113.

FIG. 17 shows a modified embodiment of the rewinder according to the present invention. Numeral 221 generally indicates a mobile member hinged about the axis of rotation A—A of the lower winder roller, again indicated by 113. The upper winder roller and the third roller are again indicated respectively with 111 and 115. Indicated by 221A is the rolling surface of the log at the beginning of winding cycle. Indicated by 285 is a comb-like element, similar to the element 185, also provided with teeth 287 cooperating with annular grooves 289 of the roller 113. R1 indicates a completed log during unloading thereof, and R2 indicates a log during the first winding step.

Also in this embodiment, the approaching movement between the surface 221A of the mobile member 221 and the cylindrical surface of the roller 111 is subdivided into two steps, but through procedures which differ from those illustrated with reference to the preceding embodiment. In fact, the mobile member 221 is moved by a disk 231 rotating about an axis 233, and pivoted through an eccentric pivot pin 235, to an elastic element 237 made up of a cylinder-piston or equivalent system hinged at 239 to an appendix 241 of the oscillating member 221. In practice, the system 231, 233, 235, 237, 239, 241 is double and disposed on the two side frames of the machine. The rotation of the disk 231 causes, via the element 237 acting as a connecting rod, movement about the axis A—A. At the moment of maximum approach of the member 221 towards roller 111, the arm 241 is in contact with an adjustable abutment 243. The position of the abutment 243 may be adjusted so that the approach will take place only at the moment the crank mechanism, made up of disk 231, pivot pin 235 and elastic element 237, is at the external dead center or even before such dead center, in which case the remaining stroke is damped by the elasticity of the pneumatic spring consisting of the cylinder-piston system 237.

In any case, the moment the arm 241 is in contact with the abutment 243, the point 221S of the surface of the mobile member is not in contact with the surface of roller 111, insofar as the final approach at very high speed is attained by moving a sector 245 of roller 111 radially outwards. The radial movement of the sector 245 may be obtained, for example, through a mechanism similar to that described in the Italian patent No. 1,231,822 whose content is made a part of the present description. The withdrawal movement of sector 245 may take place in the course of the revolution which precedes the useful contact, while the return movement to the rest position may take place during the successive revolution. The mass of sector 245 is sufficiently limited to allow, in this time interval, a timely withdrawal movement, so as to obtain the contact between the outer surface of the sector 245 and the surface 221S of the mobile member 221 upon the transit of the sector 245 in front of said mobile member 221.

The interruption of the web material N at the end of a winding cycle may be obtained also by a cutting means disposed upstream of the mobile member 121 or 221, for example, by a cutting cylinder carrying a blade co-operating with a channel in the roller 111, and by suction means which hold the (free) edge downstream of the cut to transfer it towards the mobile member 121 or 221. In this case, the approach of said mobile member to roller 111 has only the purpose of causing the free edge of the web material to be curled up and the winding for the formation of a new log to be started; such approach must take place after the free edge has passed the point of maximum approach between the roller 111 and the mobile member 221 or 121.

However, in order to simplify the machine, it is preferred to obtain the separation of the web material N by a tear due to the braking effect on said material pinched between the mobile member 121 or 221 and the roller 11, as shown schematically by the illustrated examples in the attached Figures. In this case, the tear may be facilitated by providing a longitudinal portion of the surface of the roller 111 with a coefficient of friction far lower than that of the surface which is immediately adjacent downstream with respect to the web material-feeding motion. In the embodiment of FIG. 17, for example, the mobile sector 245 may be provided with two different outer surface portions, indicated respectively by 245A and 245B. The surface 245A has a lower coefficient of friction and may be, for example, a smooth surface, while the surface 245B has a higher coefficient of friction and may be made up of, for example, a layer of emery cloth having a coefficient of friction equal to or even higher than that of the remaining surface of roller 111. With this arrangement, by suitably synchronizing the movements of the mobile member 221 and of sector 245 with the position of the perforation lines on the web material N, it is possible to cause one perforation line to lie on the surface 245A or immediately downstream thereof, just when the mobile member 221 contacts the sector 245 and to pinch the web material between the mobile member 221 and the surface 245A. This causes a sliding (facilitated by the low coefficient of friction) of the web material on surface 245A and a consequent tearing thereof in correspondence of the perforation line. The subsequent, almost immediate arrival of the portion of surface 245B having high coefficient of friction facilitates the curling of the thus generated free leading edge of the web and the beginning of the winding.

The concept set forth above, of facilitating the tearing by means of the roughness characteristics of the surface of roller 111, may be applied also to the embodiment of FIG. 13, in which case, the surfaces having low and high coefficient of friction are formed directly on the roller 111 instead of on a mobile sector of said roller.

When the surfaces of the winder roller and of the mobile member come in contact to cause the interruption of the web material and/or the beginning of the winding, the web material may have a tendency to become loose upstream of the point of contact. Means may be provided to prevent this lack of tension from spreading upstream in the web material. A suitable means for this purpose may consist of a small roller, either motor-driven or idly mounted, put in contact with the web material in the region where said material is driven onto the first winder roller. Such a small roller is shown in broken line in FIG. 13 and designated therein by 301. The contact between the rollers 111 and 301 prevents the web material N from becoming loose upstream of said rollers.

Further means may be provided to prevent the loosening in the form of a plurality of suction holes 303 in the cylindrical surface of the roller 111, which cause the adhesion of web material to the surface of the same roller 111. Such a solution is illustrated in FIG. 17. It is obvious that the two solutions are interchangeable or combinable, and may be adopted in alternative to or in combination with all the embodiments illustrated in the attached figures. When using the suction system, the vacuum inside the holes 303 may be interrupted at the right time in any well-known manner.

FIG. 18 shows schematically a portion of a small log obtained by transversely cutting a log made by the above described rewinder. As clearly shown in FIG. 18, the small log is devoid of central core. It does not exhibit any hole nor an empty central zone, but it is, instead, totally filled with material. In particular, it exhibits a central core zone, indicated by S1, wherein the turns have greater density, that is, are more tightly packed, and a more outwardly zone, indicated by S2, wherein the turns are slightly less dense. The region S1 is the one which is formed during the transit of the log within the channel defined by the surface 121A or 221A and by the surface of the roller 111. The region S2 is the one being formed during the winding between the winder rollers 111, 113 and, afterwards, between the rollers 111, 113 and 115. The more compact region S1 may have a diameter in the range of 1 to 20 mm.

The above described system makes it possible to obtain a log of web material, typically of paper type as used, for example, for the production of small rolls of toilet paper, all-purpose wipers, and the like. The paper web may be made of one or more layers and possibly joined by any known technology such as calendaring, embossing, or the like.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

What is claimed is:

1. A log of reeled web material without core or central winding tube, and without central hole, wherein the web material has a plurality of turns and wherein the innermost of said turns have a winding density almost constant and higher than the winding density of the more external turns.

2. A log of reeled web material as in claim 1, wherein the innermost turns form a central zone having a diameter in the range of 1 to 20 mm.

* * * * *